United States Patent [19]

Eberle

[11] Patent Number: 4,580,952

[45] Date of Patent: Apr. 8, 1986

[54] APPARATUS FOR LIFTING LIQUIDS FROM SUBSURFACE RESERVOIRS

[76] Inventor: William J. Eberle, 2812 Riverlake Ct., Irving, Tex. 75060

[21] Appl. No.: 618,076

[22] Filed: Jun. 7, 1984

[51] Int. Cl.[4] ..... F04B 43/10; F04B 47/08

[52] U.S. Cl. ..... 417/383; 417/478

[58] Field of Search ..... 417/383, 390, 394, 478, 417/479

[56] References Cited

U.S. PATENT DOCUMENTS 3,062,153 11/1962 Losey ..... 417/394

4,178,133 12/1979 Rawicki ..... 417/394

4,489,779 12/1984 Dickinson et al. ..... 417/394 X

*Primary Examiner*—Leonard E. Smith

*Attorney, Agent, or Firm*—Kanz, Scherback & Timmons

[57] ABSTRACT

A novel system is described for withdrawing liquids from a subsurface horizon utilizing a tubular diaphragm pump. A specific and unique pump is disclosed comprised of an elongated body member which includes a main chamber member extending longitudinally of the body member. In a preferred embodiment, a delivery tube is concentrically mounted within the chamber and forms an annulus with its outer surface and the inner walls of the chamber. The tube is provided with spaced perforations along its length within the chamber. Upper and lower check valves are in fluid communication with and at opposite ends of the delivery tube. Flexible tubing or a bladder is placed in the annulus and is normally spaced from the delivery tube. Means apply hydraulic pressure to the outer surface of the bladder to move the bladder toward the delivery tube to expel liquids out of the chamber through the upper check valve and also for releasing the hydraulic pressure to move the bladder away from the delivery tube to aspirate liquids into the chamber by way of the delivery tube through the lower check valve.

8 Claims, 8 Drawing Figures

FIG. 1
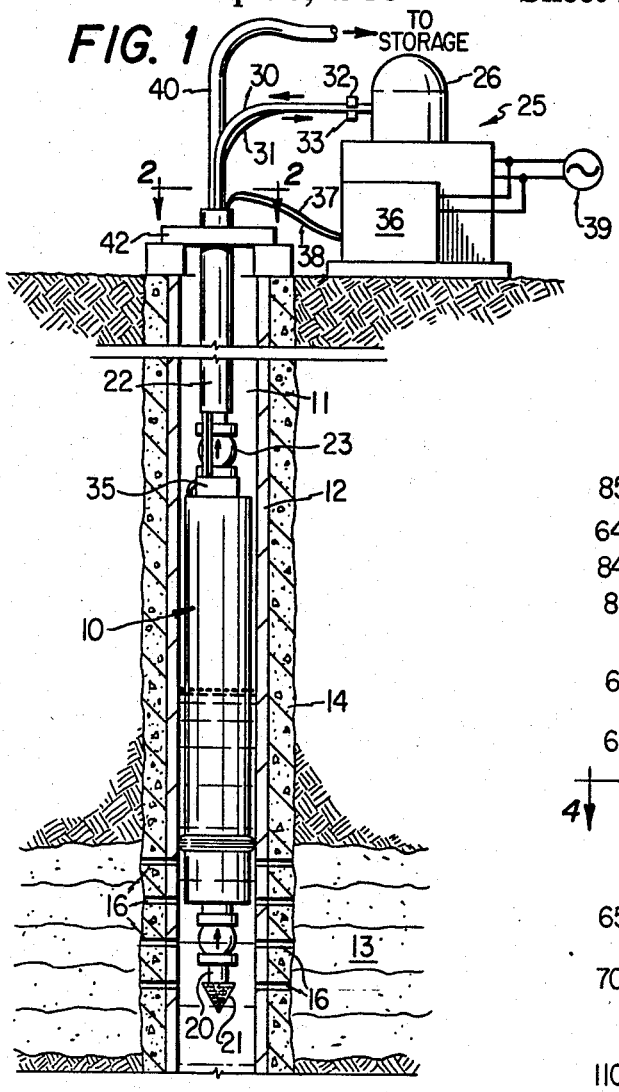
FIG. 3
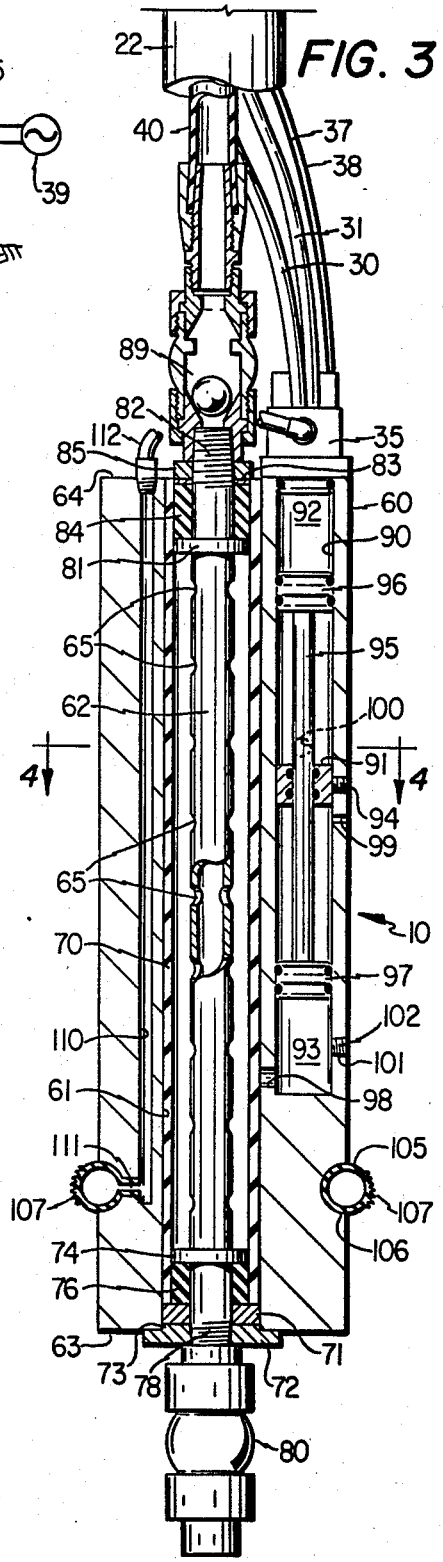
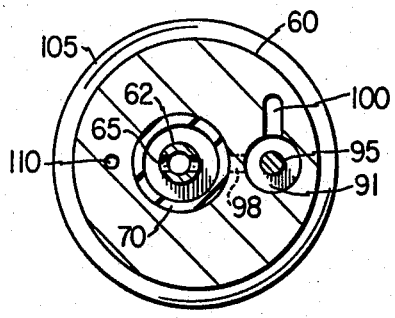
FIG. 4

APPARATUS FOR LIFTING LIQUIDS FROM SUBSURFACE RESERVOIRS

BACKGROUND OF THE INVENTION

1. Field of the Invention

This invention relates to more particularly a hydraulic type pump and to a tubular diaphragm pump of unique features to lift liquids, such as hydrocarbons, from subsurface reservoirs communicating with the earth's surface by way of cased boreholes.

2. Description of the Prior Art

Very few of the wells completed flow free of their own accord. Approximately 90% require some means of artificial lifting system to bring the wanted liquids such as hydrocarbons to the surface. The method and equipment chosen depend upon the depth of the well, the nature of the sand, and of course the cost involved. Lifting methods and apparatus fall into one of two general categories: surface and subsurface.

The rod pump system is in wide use. The "horse head" bobbing up and down is a familiar sight in oil fields around the world, and this method and apparatus of bringing oil to the surface accounts for some 80% of artificial lifting done. The heart of this type of system is the sucker rod which acts much like a flexible spring and operates under great stress. The sucker rods can be easily damaged by improper handling, and any bends, nicks, or dents can lead to metal fatique and early failure. The failure of the sucker rod requires that the rods be pulled from the well tubing at significant labor cost.

Another method of bringing liquids to the surface is by means of an electrically powered submersible pump. A centrifugal pump, together with its driving motor, is lowered down the well bore to the bottom of the well. Power is transmitted through an electrical cable from a surface control box. The pressure created by rotation of the pump's impellers then force the fluid to the surface. Because of the large power demands, problems have arisen from the failure of insulated power cable. Today, the use of the submersible pump is limited because of the expense of the system.

Subsurface hydraulic pumping has also been employed. Such a system and technique uses the oil in the field to force additional oil to the surface. A pump is located at the bottom of the well and driven by a hydraulic motor. On the surface, a standard engine-driven pump draws clean crude oil from the top of a settling tank and forces it down through tubing to the hydraulic motor. The oil, under pressure, drives the motor which in turn drives the pump. The driving oil is exhaused from the motor into the well where it mixes with the oil to be pumped and the pressure from the pump lifts both to the surface through a second string of tubing.

Tubular diaphragm pumps have been proposed in the past for a variety of uses. Typical of such apparatus is the equipment described in U.S. Pat. No. 3,951,572 utilized for the purpose of pumping cement slurry and comprised of two pumps connected in parallel. Obviously, the apparatus described in the foregoing patent is unsuitable for moving liquids from a subsurface reservoir which communicates to the earth's surface by way of a cased borehole.

There has been a need for a less labor intensive and less expensive system for lifting oil from subsurface reservoirs. Such need is satisfied by the present invention.

SUMMARY OF THE INVENTION

In accordance with the present invention, there is presented a unique tubular diaphragm pump which comprises an elongated body member including a main chamber extending longitudinally of the body member. In a preferred embodiment, the pump includes a delivery tube concentrically mounted within the chamber and forming an annulus with its outer surface and with the inner walls of the chamber. The tube has spaced perforations along its length within the chamber. Upper and lower check valves in fluid communication with the delivery tube are located at opposite ends of the delivery tube. A flexible tubing or bladder is provided in the annulus and is normally positioned adjacent the inner walls of the chamber. Means are provided for applying hydraulic pressure to the outer surface of the bladder to move the bladder toward the delivery tube to expel liquids out of the chamber through the upper check valve and for releasing the hydraulic pressure to move the bladder away from the delivery tube to aspirate liquid into the chamber by way of the delivery tube through the lower check valve.

In a preferred embodiment of the invention, the means for applying hydraulic pressure to the outer surface of the bladder comprises a cylinder which is formed in the body member and extends parallel with the chamber. A seal separates the cylinder into first and second compartments, and a piston rod extends through the seal into both compartments. The second compartment is in fluid communication with the annulus. A piston is located in each compartment and mounted to the piston rod for movement therewith. Means alternately apply liquid pressure to opposite sides of the piston in the first compartment to cause reciprocal movement of the rod and the piston in the second compartment to apply pressure to the flexible tube to drive liquids out of the chamber and then to reduce pressure applied to the flexible tube to aspirate liquids into the chamber.

Further in accordance with the present invention a system is provided for producing liquids from a subsurface reservoir connected to the earth's surface by way of a case borehole that comprises a hydraulically operated pump located in the borehole and having an inlet adjacent the reservoir. Flexible tubing extends from an outlet of the pump to the surface of the earth for conducting the liquid output of said pump to the earth's surface. A pump is located at the earth's surface and a pair of high pressure hydraulic lines extend from the surface pump to the peristaltic pump in the well bore. A flow control valve including a solenoid is mounted on the peristaltic pump for directing hydraulic pressure from the high pressure hydraulic lines to operate the peristaltic pump. The pulse rate of the pump is determined by a controller at the earth's surface which is electrically connected to the solenoid.

BRIEF DESCRIPTION OF THE DRAWINGS

FIG. 1 schematically illustrates a system embodying the present invention;

FIG. 3 is a cross-section of a tubular diaphragm pump embodying features of the present invention;

FIG. 4 is a cross-section of the pump of FIG. 3 taken along line 4—4;

DESCRIPTION OF THE PREFERRED EMBODIMENT

Figure 2:
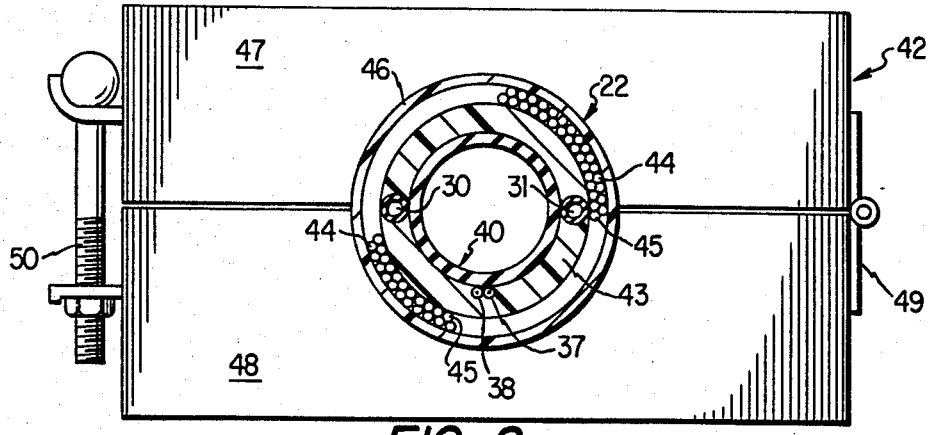
FIG. 2 is a cross-section of the conduit of FIG. 1 taken along line 2—2.

Referring now to FIG. 1, a hydraulically operated pump 10 embodying features of the present invention is illustrated in operative position within a well 11. The well 11 may either be a water well or an oil well. As illustrated, the well 11 has been completed in a manner typical for oil wells in that a casing 12 extends from the surface of the earth to a producing horizon 13 with cement 14 securing the casing in place. Perforations 16 have been provided in a manner well known in the art to provide fluid communication between the producing horizon 13 and the interior of the casing 12. The pump 10 has an inlet 20 positioned within the liquid flowing from the reservoir 13 through the perforations 16 into the cased well 11. The inlet 20 is provided with a coarse screen 21 to prevent the intake of large particles of sand or other foreign matter into the pump mechanism.

A bundle 22 of conduits, tubing, conductors and the like, extends from the outlet 23 of the pump 10 to the surface of the earth where connections are made to controller 25 and to a storage facility (not shown). The controller 25 includes a high pressure hydraulic pump 26. The output from the surface pump 26 is applied to the downhole pump 10 by way of high pressure hydraulic line 30 and the hydraulic fluid is returned from the pump 10 by way of high pressure hydraulic line 31. Both lines 30 and 31 are connected to the pump 26 by way of quick operating connectors 32 and 33.

The high pressure hydraulic liquid is selectively applied at the pump 10 under control of a solenoid operated flow control valve 35 whose operation is in turn controlled by a timing mechanism 36 electrically connected to the solenoid control valve 35 by way of electrical conductors 37 and 38. Power to operate the pump 26 and the timing mechanism 36 is derived from a suitable source 39 (not shown).

Under control of the surface equipment 25, the pump 10 is operated to move liquids from the well to the surface by way of flexible tubing 40 for transmission to a suitable storage facility such as a tank or connection may be made directly to a suitable gathering system.

The pump 10 is supported in its position within the well 11 by the bundle 22 held firm at the surface by way of a latching or locking mechanism 42. A cross section of the bundle 22 together with the latching mechanism 42 is illustrated in FIG. 2. The bundle 22 is comprised of a central core provided by the flexible tubing 40 which may be of neoprene or similar oil-resistant material, surrounded by the high pressure lines 30, 31 and the electrical conductors 37 and 38, all of which are helically wound about the tubing 42. A filler 43 of suitable material, such as polyurethane, is extruded about the foregoing named elements and the filler or extrusion 43 is in turn wrapped by layers 44 and 45 of armor wire, only portions of which are illustrated, counterwound to negate twisting and provide the mechanical stress support for the weight of the pump 10. The armor wire 44, 45 is in turn covered by a protective sheath 46 of oil-resistant plastic, if desired. This latter covering 46 is not essential.

The latching or locking mechanism 42 is illustrated schematically to be comprised of two parts 47 and 48 hinged together at 49 for pivotal movement about the bundle 22 and to thus clamp the bundle to support the downhole pump 10. Pivotal movement of the elements 47 and 48 may be accomplished by a turn buckle 50 which also locks the latching mechanism in a clamping relation with respect to the bundle 22. The latching mechanism 42 forms no part of the present invention and is illustrated merely as one arrangement whereby the downhole pump 10 may physically be supported from the surface of the earth.

Figure 8:
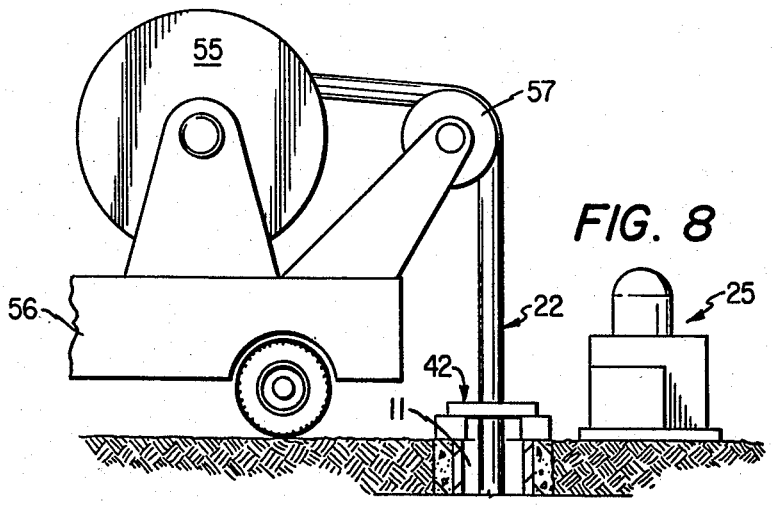
FIG. 8 illustrates a portion of the system including equipment utilized to either install the pump system or to withdraw the downhole pump from the well bore.

The system as thus far disclosed may readily be lowered into a well or withdrawn from a well with minimum time and expense compared to the efforts required in establishing a sucker rod system in a well and in withdrawing that system for repair as from time to time may be required. For example, as shown in FIG. 8, the bundle 22 may be spooled about a reel 55 carried on a suitable conveyance such as the truck 56 (the back portion only of which is illustrated) and the bundle 22 unreeled over sheave 57 to lower the pump into the well 11 by way of the open latch mechanism 42. Upon the pump 10 being placed in position opposite the producing horizon or reservoir, connections are made to the surface control system 25 as shown in FIG. 1 and operations of the pump 10 begun to initiate production from the well.

When repairs are required to the pump or workover is required of the well, the truck 56 will be brought to the well site, the various conduits, conductors and the like disconnected from the surface control system 25, and the bundle 22 spooled over and onto the reel 55 which will be driven to pull the pump and the bundle 22 from the well through the opened latching mechanism 42.

Readily apparent is the ease with which the pump system of the present invention may be added to or withdrawn from a well with significant savings in time and labor cost.

The system of the present invention includes a unique tubular diaphragm pump 10, the details of which are illustrated in FIGS. 3 and 4. The pump 10 is comprised of an elongated body member or housing 60 formed of metal such as steel. Extending entirely therethrough from one end to the other is a main or pump chamber 61 longitudinal with the housing 60. A rigid delivery tube or flow conduit 62, having perforations 65, is mounted concentrically within the main chamber 61 and extends beyond the ends 63, 64 of the housing 60. The outer surface of the delivery tube 62 forms with the inner wall surface of the main chamber an annulus in which is fitted a flexible tube or bladder 70 which will be caused to move toward and away from the delivery tube 62 to effect the pumping action for the pump 10. The lower end of the delivery tube 62 is secured to the housing by way of a washer 71 and a nut 72 having a shoulder whose diameter is approximately equal to the diameter of the main chamber 61. The lower end of the delivery tube 62 is provided with an annular flange 74 which cooperates with the nut 73 and compressible seal 76 to form a liquid tight seal and effectively secure the bladder 70 to the inner wall surface of the chamber 61. This is accomplished by rotating the nut 73 on the lower threaded portion 78 of the delivery tube 62 to effectively move the flange 74 of the delivery tube toward the nut 72, causing the seal 76 to be compressed and distorted radially to apply pressures evenly to the bladder 70.

A check valve 80 is connected in fluid tight communication with the lower end of the delivery tube and arranged so as to permit the ingress of liquids by way of the strainer or screen 21 (FIG. 1) into the chamber 61 by way of the delivery tube 62 through the perforations 65 in the delivery tube during the aspiration mode of the pump 10. On the other hand, during the positive pressure mode of the pump 10, the check valve 80 will close and prevent movement of liquids from the chamber 61 back into the well.

The upper portion of the pump 10 and of the delivery tube 62 are of similar construction to that of the lower end in that the delivery tube has a flange 81 adjacent the threaded end 82 of the delivery tube. A washer 83 having a diameter approximately equal to the inside diameter of the bladder 70 is placed over a seal 84 of cylindrical shape. After the lower portion of the delivery tube has been secured, a nut 85 is threaded onto the upper end of the delivery tube 62 and rotated to force the washer 83 against the seal 84, causing it to deform radially and thus create a fluid tight seal at the upper end of the main chamber and in deforming radially cause the upper end of the bladder 70 to be secured to the upper portion of the main chamber and to the sidewalls thereof.

A second check valve 89 is mounted to the upper end of the delivery tube 62. The check valve 89 is in fluid communication with the conduit or tubing 40 to conduct liquids from the pump, during the pressure or discharge mode, to the surface of the earth. The check valve 89 will open during the pressure or discharge mode of the pump 10 and will close during the aspiration mode of the pump.

The utilization of the delivery tube 62 is preferred by reason of providing added strength to the pump, providing a delivery and support means for the pump and enabling a streamlined design desirable for equipment to be utilized in cased wells. The delivery tube 62 also provides the function of limiting the inward movement of bladder 70 and thus places a limit on the maximum pressures to be applied to liquids in the pump chamber. If desired the delivery tube may be dispensed with. For example, the central perforated portion of the delivery tube may be eliminated while maintaining intact flanges 74 and 81 and the portions of structure above flange 81 and below flange 74 while providing suitable mechanical structure at the top of the housing 60 for securing it to the bundle 22.

Means are provided in the housing of pump 10 for applying hydraulic pressure to the outer surface of the bladder or flexible tubing 70 to move the bladder toward the delivery tube 62 to expel liquids out of the main chamber through the perforations 65 in the delivery tube and the upper check valve 89. The means also provides for the release of hydraulic pressure to move the bladder 70 away from the delivery tube 62 to aspirate liquids into the chamber 61 by way of the lower check valve 80, the delivery tube 62 and the perforations 65 in the delivery tube.

Specifically, the means is provided by a cylinder 90 formed in the body of the pump and extending parallel with the main chamber. A seal and bearing structure 91 separates the cylinder into first and second compartments 92 and 93. The seal bearing structure 91 is held in position by way of set screw 94. A rod 95 extends through the structure 91 and pistons 95 and 96 are mounted to the rod 95 for movement therewith. The lower compartment 93 is in fluid communication with the chamber 61 by way of a port 98 which admits liquids from the chamber 93 into the chamber to apply pressure against the outer surface of the bladder 70 and to relieve that pressure through the same aperture 98.

A bore 100 is provided in the housing 60 extending from a lower portion of the upper compartment 92 to the top of the housing 60 where it communicates with a high pressure port of the directional control flow valve 35. Pressure may thus be applied to the lower face of piston 96 to move the piston upward. Liquid communication by way of a bore (not shown) is provided in the upper portion of the housing 60 between the upper portion of the compartment 92 and another high pressure port of the valve 35. Pressure may thus be applied to the upper face of piston 96 to move the piston downward. A fill port 101 is provided to enable the admission of hydraulic liquid into the lower compartment 93 when the piston 97 is an uppermost position. The fill port may be sealed with a suitable machine screw or set screw 102.

A breather port 99 is provided through the wall of the cylinder 90 in the upper portion of compartment 93 immediately adjacent the underside of seal 91. The purpose is to intake to and discharge from the upper portion of compartment 93, above the piston 97, fluids in the well surrounding the upper portion of the pump 10 and thus avoid the creation of pressurized fluids above the piston 97 which would inhibit proper operation of the pistons 96 and 97.

If desired, a hydraulic packer 105 comprised of an expandable ring located on the housing 60 partially within a circumferential recess 106 formed about the lower portion of the housing 60. The packer 105 will serve two purposes. One is to seal off the producing horizon from any materials within the casing above the horizon and also to provide the function of at least in part supporting the weight of the pump 10 in the well and thus relieving some of the strain on the bundle 22. An improved contact with the inner surface of the well casing may be had by providing the outer surface of the packer 105 with serrated or a rough surface 107.

A bore 110 is provided in the housing 60 extending from a port 111 in the packer 105 to the top of the housing 60 where liquid communication is had with a hose 112 interconnecting the bore 110 with a high pressure port of the flow control valve 35.

It is apparent from the above discussion that a separate high pressure line, either pneumatic or hydraulic may be run from the surface directly to bore 110 to operate the packer 105.

Figure 6:
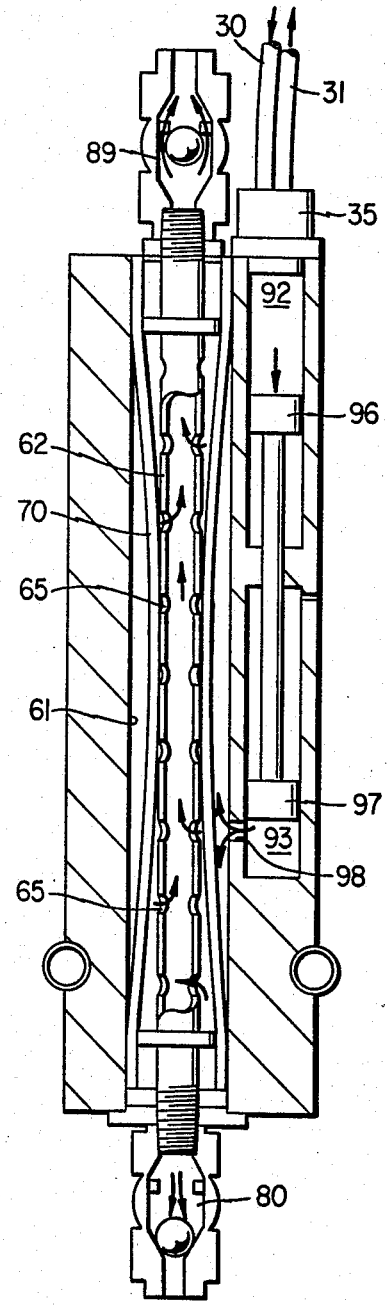
FIG. 6 is a cross-section of the pump of the present invention illustrating the application of hydraulic pressure to expel fluids out of the pump chamber through an upper check valve.
Figure 7:
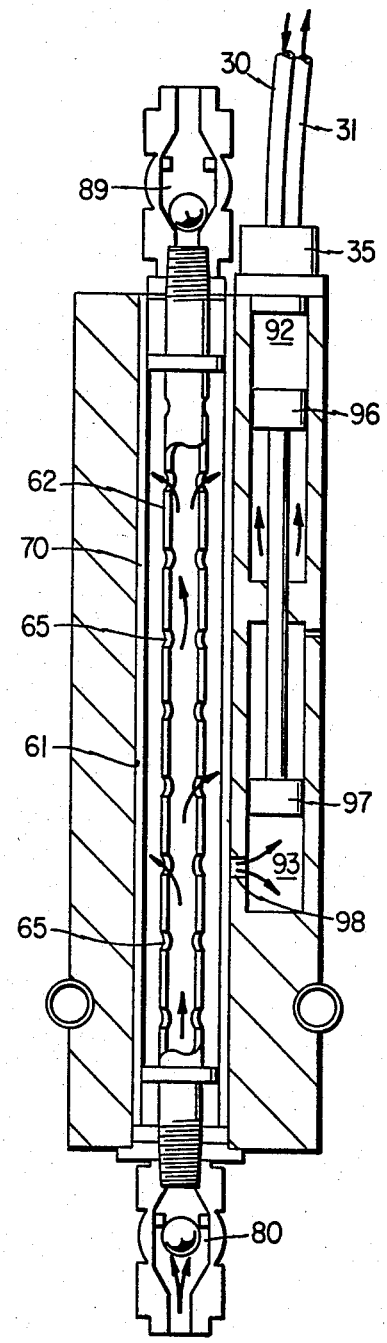
FIG. 7 is a cross-section of the pump of the present invention illustrating the pump in an aspirating state drawing liquids into the chamber by way of the lower check valve.

Operation of the pump of the present invention is schematically illustrated in FIGS. 6 and 7. The lower compartment 93 having initially been filled with hydraulic fluid, high pressure is admitted to the upper portion of the compartment 92 to cause the piston 96 to move in a downward direction. The downward movement of the piston 96 also causes the piston 97 to move downward and force the hydraulic liquid in the compartment 93 to move through port 98 to enter chamber 61 and move the bladder 70 toward the delivery tube 62. The movement of the bladder increases the pressure between the bladder and the delivery tube and this pressure, applied to any liquids existing between the bladder and the delivery tube, moves the liquids through the ports 65 in the delivery tube as illustrated by the arrows and through the now open check valve 89 into the flexible tubing 40 for movement to the earth's surface. In the next cycle, as illustrated in FIG. 7, high pressure is now applied to the underside of piston 96 via bore 100 (not shown) to cause the piston 96 as well as the piston 97 to move in an upward direction. The upward movement of the piston 97 will have an aspirating effect within the chamber 61, causing the bladder 70 to move away from the delivery tube 62. The lower check valve 80 is opened to cause well liquids to move through the check valve 80 up into the chamber 61 by way of the ports 65 in the delivery tube 62. The cycles are repeated, causing liquids to move by way of the pump to the earth's surface through the flexible tubing 40.

High pressure is applied to either side of the piston 96 by way of the hose 30 as selected by the flow control valve 35. As pressure is applied to one side of the piston 95, the hydraulic pressure on the opposite side is relieved by way of ports and passageways in the flow control valve 35 to the hose 31 for return to the surface and an inlet port of the high pressure pump 26 (FIG. 1).

Figure 5:
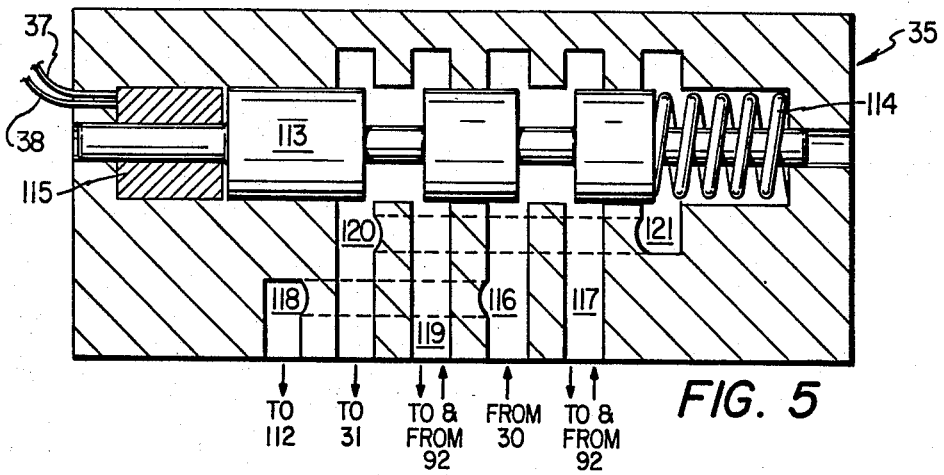
FIG. 5 is a cross-section of a suitable spring biased solenoid operated flow control valve.

Directional flow control valves are available from many sources. One such source is Double A, division of Brown and Sharp Manufacturing Co. of Manchester, Mich. A cross-sectional view of a directional flow control valve suitable for the practice of the present invention is illustrated in FIG. 5. The flow control valve 35 is of the spring-biased solenoid operated type. The valve 35 includes a spool 113 biased to an offset position by spring 114 and movable to a second position under control of solenoid 115 connected to the conductors 37 and 38, electrically connecting the solenoid 115 with the timing control 36 at the earth's surface.

The flow control valve 35 includes a plurality of bores which provide passageways for the selective flow of liquids through the valve. As illustrated, a passage 116 is connected to the high pressure inlet hose 30 and in the illustrated offset position, the high pressure will be applied through the passage 116 by way of the spool 113 to passage 117, and thence to one side of the piston 96 located in the compartment 92. The passage 116 communicates directly with passage 118 to apply at all times high pressure to the hose 112 to pressurize or otherwise activate the packer 105 (FIG. 3). In this offset position, a passage 119 communicates via the spool 113 with a passage 120 to exhaust hydraulic liquids from an opposite side of the piston 96 in compartment 92 to the return high pressure line 31 leading to the earth's surface and to the surface pump 26.

Upon generation of an electrical signal from the timing equipment 36 at the earth's surface, the solenoid 115 is energized to move the spool 110 to the right, whereupon communication is had between the passage 116 and the passage 119 via the spool 110 to apply high pressure to an opposite side of the piston 96 in the compartment 92. At the same time liquid communication is effected between the passage 117 and the passage 120 via passage 121 to relieve hydraulic pressure on an opposite side of the piston.

When the solenoid 115 is de-energized, the spring 114 again moves the spool 113 to its illustrated offset position, causing a repeat of the cycle which effectively causes the piston 97 in the compartment 93 alternately to apply and withdraw pressure to the chamber 61 and to the bladder 70, creating a pulsating action by the pump 10 to withdraw liquids from the producing horizon and move those liquids up the flexible tubing 40 to the earth's surface.

Now that the invention has been described, modifications will be obvious to those skilled in the art, and it is intended to cover all such modifications as fall within the scope of the appended claims.

What is claimed is:

1. A hydraulically operated downhole pump for transferring liquids from a subsurface reservoir to the earth's surface comprising:

an elongated body member having flow conduit extending longitudinally of the body member, upper and lower check valves in fluid communication with and at opposite ends of said flow conduit, a pump chamber, a cylinder formed in said body member and extending parallel with said flow conduit, a seal separating said cylinder into first and second compartments, a piston rod extending through said seal into both compartments, a piston in each compartment and mounted to said rod for movement therewith, and means for alternately applying liquid pressure to opposite sides of the piston in said first compartment to cause reciprocal movement of said rod and said piston in said second compartment to apply pressure to said pump chamber to drive liquids out of said chamber by way of said flow conduit and said upper check valve and then to reduce pressure applied to said pump chamber to aspirate liquids into said chamber by way of said flow conduit and said lower check valve.

2. A system for producing liquids from a sub-surface reservoir connected to the earth's surface by way of a cased borehole, comprising:

a hydraulically operated pump located in the borehole and having an inlet adjacent the reservoir, flexible tubing extending from an outlet of said pump to the surface of the earth for conducting the liquid output of said pump to the earth's surface, a pair of high pressure hydraulic lines, a pump at the earth's surface, said hydraulic lines extending from said surface pump to said hydraulically operated pump in the well bore, a flow directing valve for directing hydraulic pressure from said lines to operate said hydraulically operated pump, said valve including a solenoid, a controller for said flow directing valve at the earth's surface, electric circuit means extending from said controller to said solenoid whereby the pulse rate of said hydraulically generated pump is controlled from the earth's surface, said hydraulically operated pump including an elongated body member having flow conduit extending longitudinally of the body member, upper and lower check valves in fluid communication with and at opposite ends of said flow conduit, a pump chamber, a cylinder formed in said body member and extending parallel with said chamber, a seal separating said cylinder into first and second compartments, a piston rod extending through said seal into both compartments, a piston in each compartment and mounted to said rod for movement therewith, means for alternately applying hydraulic pressure to opposite sides of the piston in said first compartment to cause reciprocal movement of said rod and said piston in said second compartment to apply pressure to said pump chamber to drive liquids out of said chamber by way of said flow conduit and then to reduce pressure applied to said pump chamber to aspirate liquids into said chamber by way of said flow conduit.

3. The system of claim 2 in which said flow conduit is a delivery tube concentrically mounted within said pump chamber and forming an annulus with its outer surface and inner walls of said chamber, said tube having spaced perforations along its length within said chamber, and flexible tubing in said annulus about said tube, wherein said hydraulic pressure is applied to the outer surface of said flexible tubing to move said tubing toward said delivery tube to expel liquids out of said chamber through said upper check valve and for releasing said hydraulic pressure to move said tubing away from said delivery tube to aspirate liquids into said chamber by way of said delivery tube through said lower check valve.

4. A downhole pump for transferring liquids from a subsurface reservoir to the earth's surface comprising:

and elongated body member including a main chamber extending longitudinally of the body member a delivery tube concentrically mounted within said chamber and forming an annulus between its outer surface and the inner walls of said chamber, said tube having spaced perforations along its length within said chamber, upper and lower check valves in fluid communication with and at opposite ends of said delivery tube, flexible tubing in said annulus and normally adjacent the inner walls of said chamber, a cylinder formed in said body member and extending parallel with said chamber, a seal separating said cylinder into first and second compartments, a piston rod extending through said seal into both compartments, said second compartment in fluid communication with said annulus, a piston in each compartment and mounted to said rod for movement therewith, means for alternately applying hydraulic pressure to opposite sides of said piston in said first compartment to cause reciprocal movement of said rod and said piston in said second compartment to apply pressure to said flexible tubing to drive liquids out of said chamber by way to said delivery tube and then to reduce pressure applied to said flexible tube to aspirate liquids into said chamber by way of said delivery tube.

5. The downhole pump of claim 1 in which:

unperforated ends of said delivery tube extend beyond opposite ends of said body member, and means for mechanically securing said delivery tube to said body member at the unperforated ends.

6. The downhole pump of claim 5 in which said securing means includes a seal, and means for applying pressure to said seal to effect a liquid tight connection between said delivery tube and said chamber at opposite ends thereof.

7. The downhole pump of claim 1 in which said means for applying hydraulic pressure includes a solenoid operated flow control valve.

8. The downhole pump of claim 7 in which there is included a hydraulically operated packer located on said body member for engaging wall structure of well casing and further in which said packer is operated by way of said flow control valve.

* * * * *